US005296642A

United States Patent [19]

Konishi

[11] Patent Number: 5,296,642

[45] Date of Patent: Mar. 22, 1994

[54] AUTO-PLAY MUSICAL INSTRUMENT WITH A CHAIN-PLAY MODE FOR A PLURALITY OF DEMONSTRATION TONES

[75] Inventor: Shinya Konishi, Hamamatsu, Japan

[73] Assignee: Kabushiki Kaisha Kawai Gakki Seisakusho, Shizuoka, Japan

[21] Appl. No.: 958,694

[22] Filed: Oct. 9, 1992

[30] Foreign Application Priority Data

Oct. 15, 1991 [JP] Japan ..... 3-295060

[51] Int. Cl.[5] ..... G10H 1/00

[52] U.S. Cl. ..... 84/609

[58] Field of Search ..... 84/609-614, 84/634-638

[56] References Cited

U.S. PATENT DOCUMENTS 5,138,925 8/1992 Koguchi et al. ..... 84/609

*Primary Examiner*—Stanley J. Witkowski

[57] ABSTRACT

An auto-play musical instrument which has external and internal data storages for auto-play data is disclosed. The auto-play data contain a plurality of music piece data for demonstration tones or background tones. A demonstration button is provided to set a mode for playing back one of music pieces with designating a play number of the auto-play data. A play controller is provided to automatically start a chain-play of the music pieces stored in the external and internal storages when a fixed time interval has passed without any designation of the play number after the set of the demonstration mode.

2 Claims, 6 Drawing Sheets

AUTO-PLAY MUSICAL INSTRUMENT WITH A CHAIN-PLAY MODE FOR A PLURALITY OF DEMONSTRATION TONES

BACKGROUND OF THE INVENTION

1. Field of the Invention

The present invention relates to an auto-play apparatus and, more particularly, to an auto-play apparatus capable of performing a continuous auto-play of music pieces.

2. Description of the Related Art

In recent years, an electronic musical instrument such as an electronic piano, an electronic keyboard, or the like is placed in an electronic musical instrument exhibition floor, various showrooms, shops, or the like, and is set to perform an auto-play so as to appeal the performance of the electronic musical instrument or so as to provide a background music.

In such a use, a user operates an operation member of an auto-play apparatus built in the electronic musical instrument to select a music piece to be played, and also operates another operation member to repetitively and continuously automatically play the selected music piece, thereby instructing a continuous auto-play of the music piece.

However, since the above-mentioned conventional auto-play apparatus only repetitively plays a selected music piece, this results in poor variation, and the selected music piece cannot be used as a background music for a long period of time. The user must also operate the operation member for selecting a music piece, and the operation member for instructing a continuous auto-play of the selected music piece, resulting in cumbersome operations. It is difficult for a clerk who is not accustomed with the operation of the electronic musical instrument to perform such operations, and the operations of the operation members require much time. Thus, the play cannot be started at a good timing upon arrival of a customer.

SUMMARY OF THE INVENTION

It is an object of the present invention to provide an auto-play apparatus which can quickly start a continuous auto-play of a plurality of music pieces by an easy operation.

According to one aspect of the present invention, an auto-play apparatus having storage means for storing auto-play data of a plurality of music pieces, and play means for performing an auto-play based on the auto-play data stored in the storage means, comprises mode set means for setting a demonstration mode for performing a continuous auto-play of a music piece, music piece selection means for selecting a music piece to be continuously played back in the demonstration mode, instruction means for, when the music piece selection means does not select a music piece for a predetermined period of time after the demonstration mode is set by the mode set means, instructing to start a chain-play for sequentially and continuously playing back a plurality of music pieces, and play means for, when the instruction means instructs to start the chain-play, sequentially reading out auto-play data of a plurality of music pieces from the storage means, and performing a continuous auto-play of the plurality of music pieces.

According to another aspect of the present invention, the storage means comprises an external storage unit and an internal storage unit arranged in an apparatus main body, and the apparatus further comprises data read-out means for, when the start of the chain-play is instructed, starting a read-out operation of auto-play data from one of the two storage units, and for, when playback operations of music pieces stored in one storage unit are ended, performing a read-out operation of auto-play data from the other storage unit.

According to the present invention, if only a demonstration mode operation member is operated to set a demonstration mode, the instruction means automatically instructs to start a chain-play after an elapse of a predetermined period of time without selection of music pieces, and the play means performs a continuous auto-play of a plurality of music pieces.

When the storage means is constituted by external and internal storages, and the data read-out means is provided, all the music pieces stored in the external and internal storages can be continuously and automatically played, thus obtaining a continuous play of a very large number of kinds of music pieces.

DETAILED DESCRIPTION OF THE PREFERRED EMBODIMENT

The preferred embodiment of the present invention will be described hereinafter with reference to the accompanying drawings.

Figure 2:
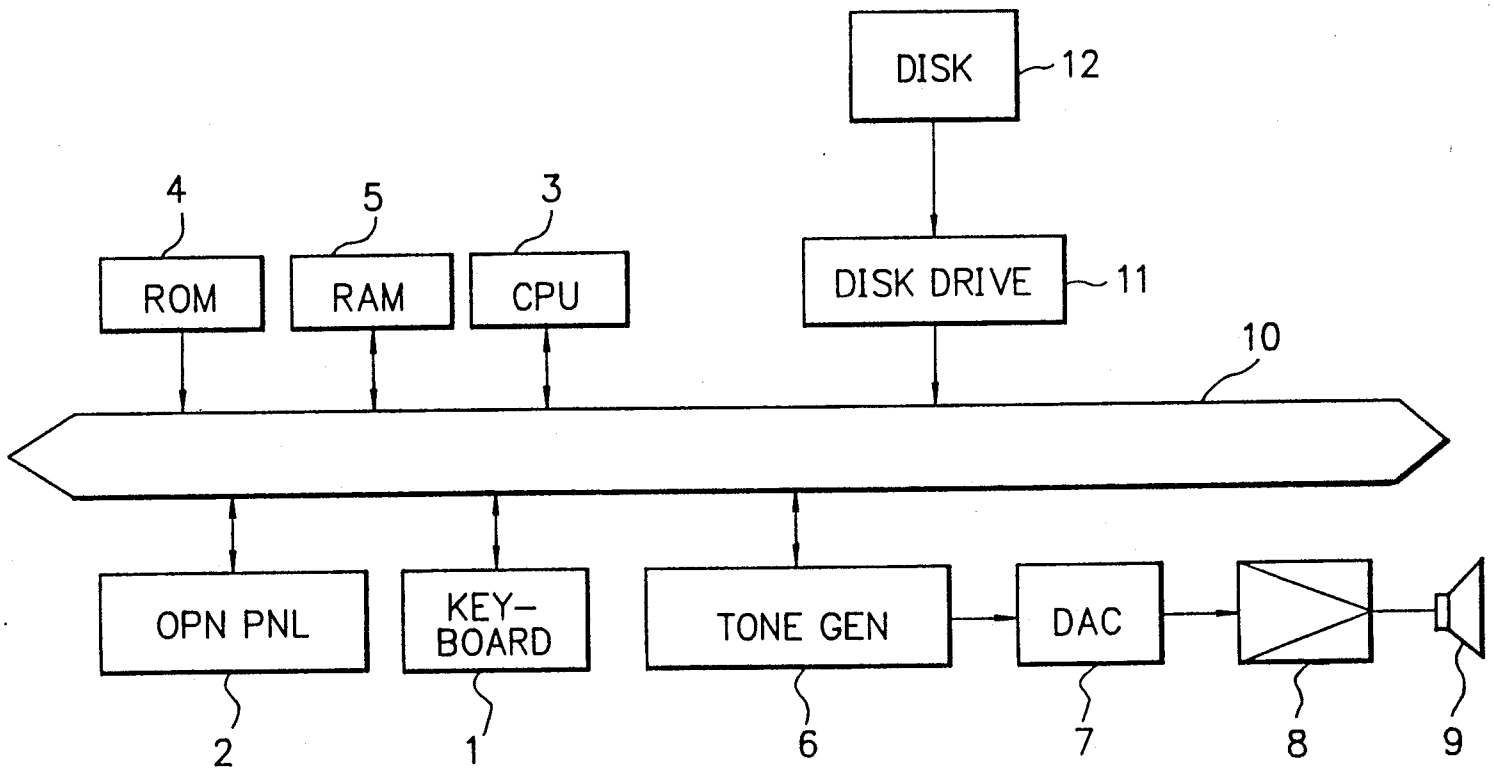
FIG. 2 is a block diagram for explaining a schematic arrangement of an electronic musical instrument such as an electronic keyboard, which adopts the present invention.

FIG. 2 is a block diagram for explaining a schematic arrangement of an electronic musical instrument such as an electronic keyboard, which adopts the present invention.

In FIG. 2, a keyboard 1, an operation panel 2, a CPU 3, a ROM 4, a RAM 5, a tone generator 6, and a disk driver 11 are connected to a bus line 10 including a data bus, an address bus, and the like so as to exchange data with each other.

The keyboard 1 comprises one or a plurality of keyboards, each of which includes a plurality of keys and key switches arranged in correspondence with the keys. Each key switch can detect ON and OFF events of the corresponding key, and can also detect the operation speed of the corresponding key.

Figure 1:
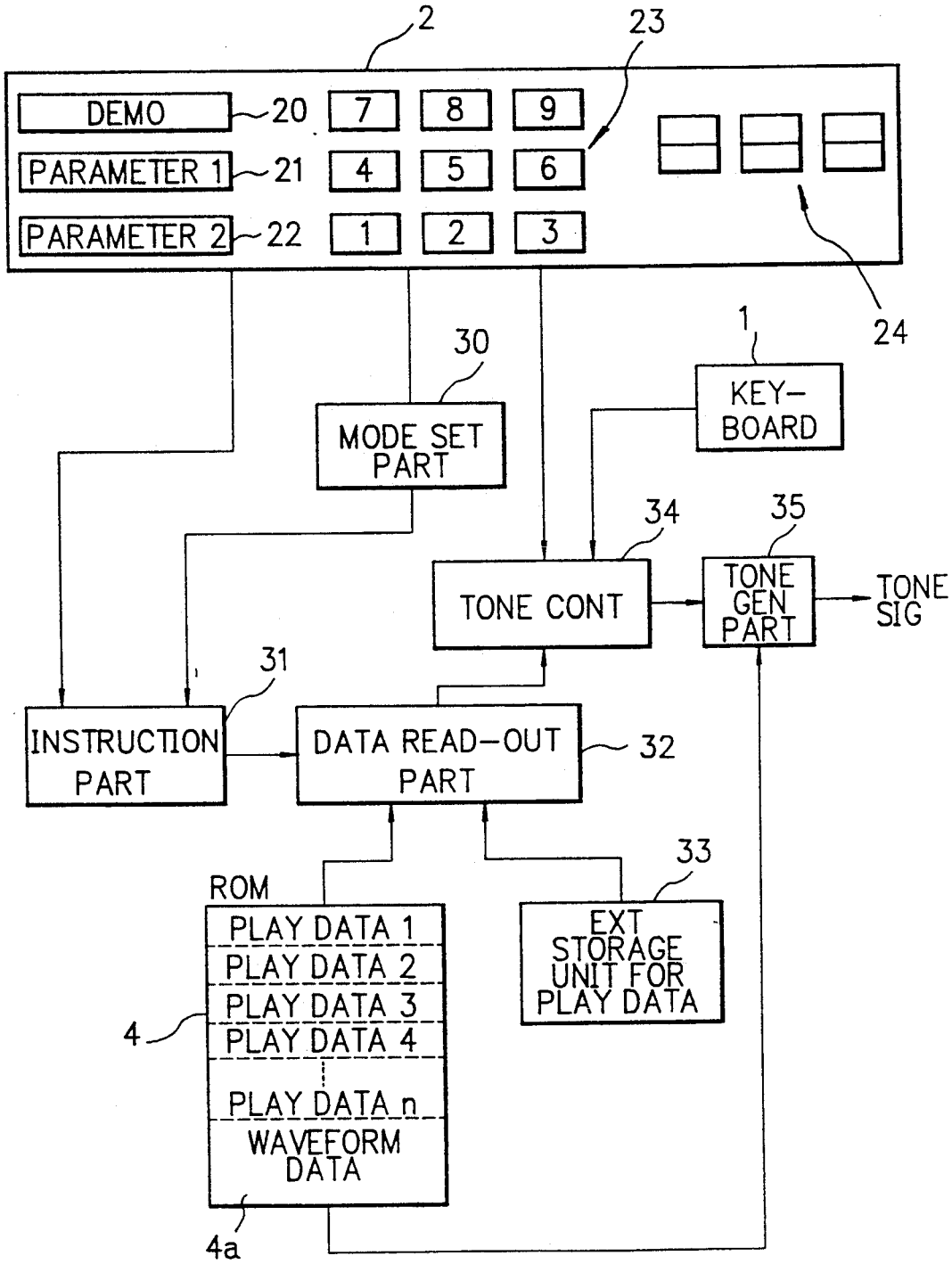
FIG. 1 is a block diagram showing elementary features of the present invention.

On the operation panel 2, as shown in FIG. 1, a demonstration switch 20, operation members 21 and 22 for setting parameters for controlling a rhythm, a tone color, a tone volume, an effect, and the like, a ten-key pad 23 for inputting a numerical value, a display 24 for displaying various kinds of information, an operation member (not shown) for instructing an auto-play based on auto-play data, and the like are arranged. The demonstration switch 20 is a mode selection switch for setting a demonstration mode for performing a continuous auto-play of one or a plurality of music pieces. The switch 20 also serves as an operation member for instructing a chain-play mode for performing a continuous auto-play of a plurality of music pieces.

The CPU 3 performs scan processing of the key switches of the keyboard 1 and scan processing of the operation members of the operation panel 2 according to a program stored in the ROM 4 so as to detect an operation state (an ON or OFF event, a key number of the depressed key, a velocity associated with the depression speed of the key, and the like) of each key on the keyboard 1 and the operation state of each operation member of the operation panel 2. The CPU 3 then executes various kinds of processing (to be described later) according to the operation of each key or operation member, and also executes various kinds of processing for an auto-play on the basis of auto-play data.

The ROM 4 stores a work program of the CPU 3, tone waveform data, and display data for the display 24, and also stores auto-play data 1 to n used in an auto-play mode as preset data. Each auto-play data consists of data such as a tone color number for specifying a type of tone color, a key number for specifying a type of key, a step time indicating a tone generation timing, a gate time representing a tone generation duration, a velocity representing a key depression speed (tone volume), a repeat mark indicating a repeat point, and the like.

The RAM 5 temporarily stores various kinds of information during execution of various kinds of processing by the CPU 3, and also stores information obtained as a result of various kinds of processing.

The tone generator 6 comprises a plurality of tone generation channels, and can simultaneously generate a plurality of tones. The tone generator 6 reads out tone waveform data from the ROM 4 on the basis of key number information representing each key, tone parameter information set upon operation of each operation member, auto-play data, and the like sent from the CPU 3, processes the amplitude and envelope of the waveform data, and outputs the processed waveform data to a D/A converter 7. An analog tone signal obtained from the D/A converter 7 is supplied to a loudspeaker 9 through an amplifier 8.

A disk 12 as an external storage unit such as a floppy disk is connected to the bus line 10 through the disk driver 11. The disk 12 stores auto-play data corresponding to a plurality of music pieces.

FIG. 1 is a block diagram showing the elementary features of the present invention. A mode set part 30 sets a mode such as the above-mentioned demonstration mode, the chain-play mode for performing a chain-play, an auto-play mode for performing an auto-play based on auto-play data, a parameter setting mode, or the like according to an operation of the operation member such as the demonstration switch 20 provided to the operation panel 2. An instruction part 31 instructs a data read-out part 32 to start a chain-play or a single repeat play (a continuous play of a single music piece), and designates auto-play data to be read out by the data read-out part 32. When a predetermined period of time elapses from an ON operation of the demonstration switch 20, the instruction part 31 instructs the data read-out part 32 to start the chain-play.

The data read-out part 32 reads out auto-play data from the ROM 4 as an internal storage unit or an external storage unit 33 (disk 12) according to an instruction from the instruction part 31, and supplies the readout data to a tone control part 34. More specifically, when the instruction part 31 instructs to start a chain-play, the data read-out part 32 sequentially reads out play data of music pieces stored in the external storage unit 33 through the disk driver 11. After all the music pieces stored in the storage unit 33 are played, the data read-out part 32 successively starts to read out play data of music pieces stored in the ROM 4. When the instruction part 31 instructs to start a single repeat play, the data read-out part 32 repetitively reads out play data of a music piece designated by the instruction part 31 from the storage unit 33 or the ROM 4. Since the data read-out part 32 performs such data read-out operations, the chain-play or single repeat play mode can be realized.

The tone control part 34 adds tone parameter information such as a tone color, a tone volume, and the like set upon operation of the operation members to depressed key information sent from the keyboard 1, and supplies the sum information to a tone generation part 35. In addition, the tone control part 34 supplies auto-play data sent from the data read-out part 32 to the tone generation part 35.

The tone generation part 35 reads out a corresponding PCM tone source waveform from a waveform ROM 4*a* on the basis of tone data sent from the tone control part 34, thus forming a tone signal.

The mode set part 30, the instruction part 31, the data read-out part 32, and the tone control part 34 mentioned above are realized by a microcomputer system consisting of the CPU 3, the RAM 5, and the ROM 4.

Figure 3:
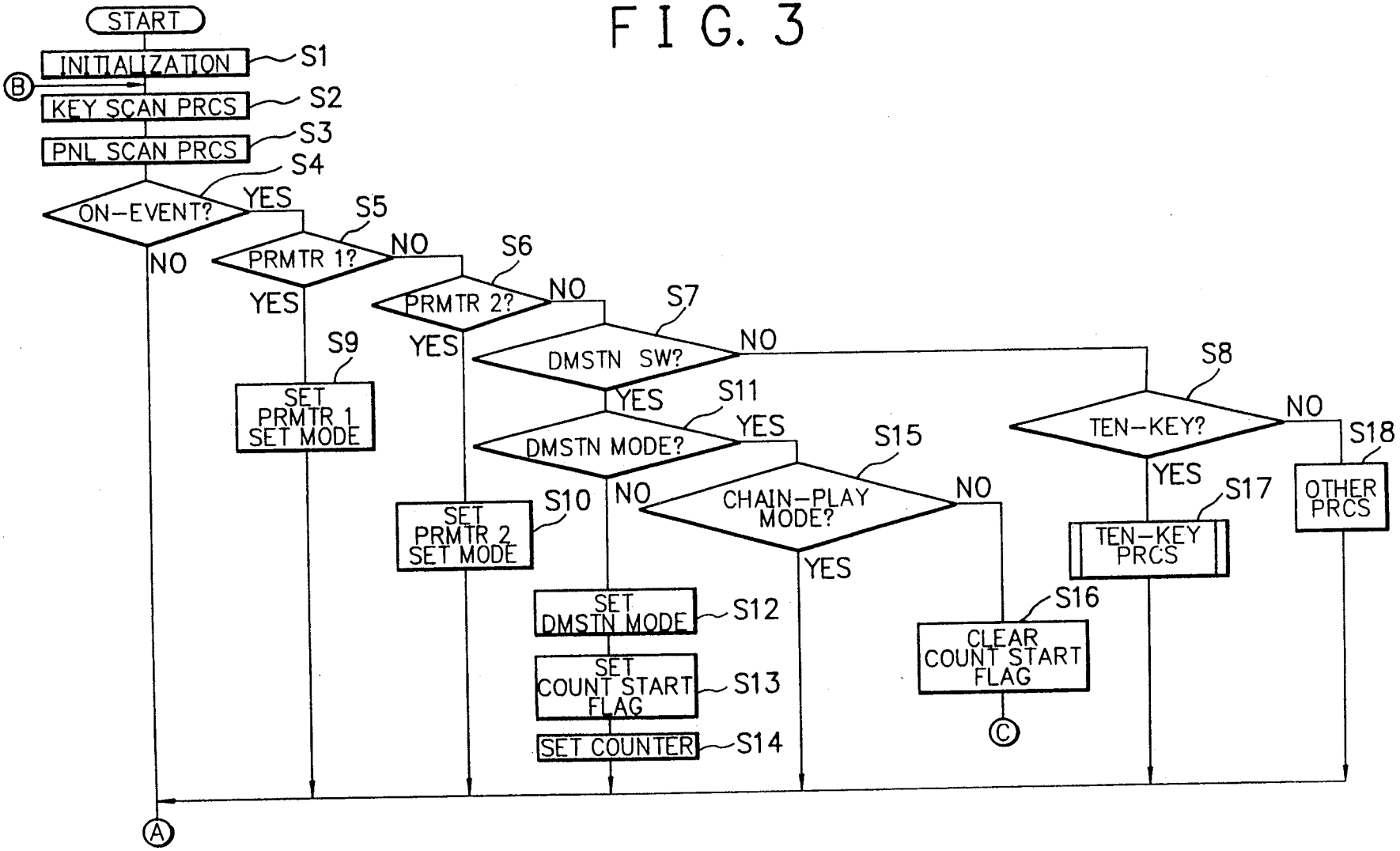
FIG. 3 is a flow chart showing a main processing sequence executed by a CPU 3.
Figure 4:
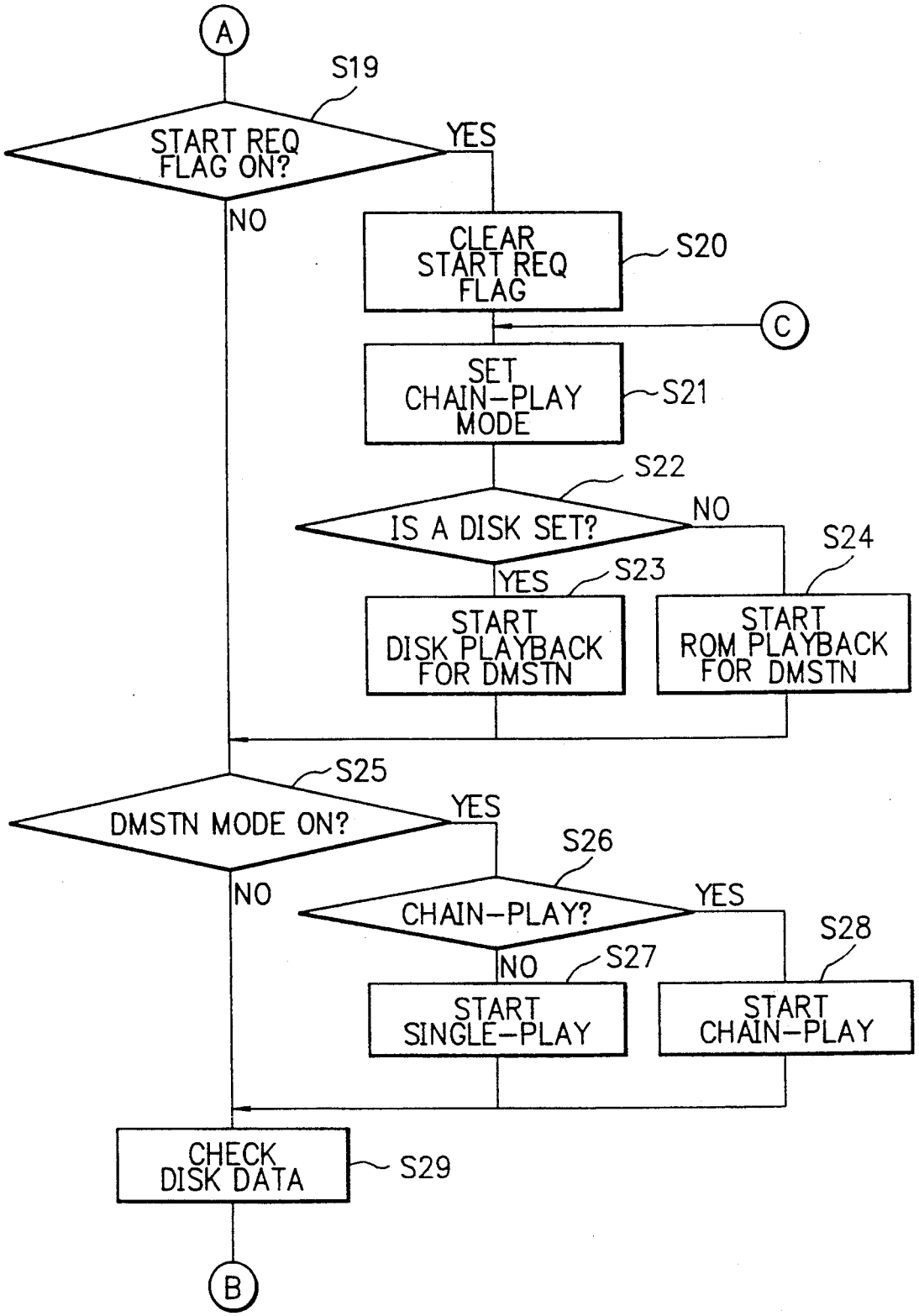
FIG. 4 is a flow chart showing the main processing sequence executed by the CPU 3.

FIGS. 3 and 4 are flow charts showing a main processing sequence executed by the CPU 3.

When the power switch of the electronic musical instrument is turned on, the CPU 3 performs initialization in step S1 to initialize a tone generator (tone source), clear the RAM 5, and so on. In step S2, the CPU 3 executes key scan processing for sequentially checking the operation states of all the keys on the keyboard 1. When an operated key is detected, the CPU 3 executes processing corresponding to the key operation. In step S3, the CPU 3 executes panel scan processing for sequentially checking the operation states of all the operation members on the operation panel 2. If an ON-event of the operation member is detected in step S4, the flow advances to steps S5 to S8 to detect whether the operation member corresponding to the ON-event is the parameter 1 set operation member 21, the parameter 2 set operation member 22, the demonstration switch 20, or the ten-key pad 23. If it is detected that the operation member corresponding to the ON-event is the parameter 1 set operation member 21 (step S5), a parameter 1 set mode for setting a parameter 1 (e.g., a tone color parameter) is set in step S9, and the control advances to the next processing. If it is detected that the operation member corresponding to the ON-event is the parameter 2 set operation member 22 (step S6), a parameter 2 set mode for setting a parameter 2 (e.g., a rhythm parameter) is set in step S10, and the control then advances to the next processing.

If it is detected that the operation member corresponding to the ON-event is the demonstration switch 20 (step S7), it is checked in step S11 if the demonstration mode is currently set. If YES in step S11, the flow advances to processing in step S15; otherwise, the demonstration mode is set in step S12, and thereafter, the flow advances to step S13. In step S13, a count start flag is set, and in step S14, a predetermined value is set in a counter for measuring a predetermined period of time. Thereafter, the flow advances to step S19.

If it is determined in step S11 that the demonstration mode has already been set, it is checked in step S15 with reference to a corresponding flag (chain-play mode flag) if the chain-play mode is set. If YES in step S15, the flow advances to step S19; otherwise, the flow advances to step S16 to clear the count start flag, and thereafter, the control advances to processing in step S21 and subsequent steps so as to start a chain-play.

If it is determined in steps S5 to S7 that the operation member corresponding to the ON-event is none of the parameter 1 set operation member 21, the parameter 2 set operation member 22, and the demonstration switch 20, it is checked in step S8 if the operation member corresponding to the ON-event is the ten-key pad 23. If YES in step S8, ten-key processing (to be described later) is executed in step S17; otherwise, processing corresponding to the operated operation member is executed in step S18. Thereafter, the flow advances to step S19.

In step S19, it is checked if a start request flag (see step S4 in FIG. 5), which indicates that the predetermined period of time has passed after the ON-event of the demonstration switch 20, is set. If YES in step S19, the flow advances to step S20 to clear the start request flag, and in step S21, the chain-play mode is set. Thereafter, decision step S22 is executed.

In step S22, it is checked if the disk 12 is connected (i.e., if auto-play data is stored in the disk 12). If the disk 12 (auto-play data stored in the disk 12) is detected, a disk demonstration play for sequentially playing back (performing a chain-play of) auto-play data stored in the disk 12 is started in step S23. If no disk 12 is detected, an internal ROM demonstration play for sequentially playing back (performing a chain-play of) play data stored in the internal ROM 4 is started in step S24.

It is checked in steps S25 and S26 if the demonstration mode and the chain-play mode are set. If YES in both steps S25 and S26, the flow advances to step S28 to execute data read-out & playback processing for a chain-play. If NO in step S26, the flow advances to step S27 to execute data read-out & playback processing for a single repeat play (a continuous auto-play of a single music piece). A difference between processing operations in steps S27 and 28 is as follows. That is, when auto-play data is read out, and a repeat mark of each music piece is read in a playback mode, in the single repeat play processing in step S27, play data is read out again from the start portion of a music piece played back so far so as to play back the music piece again, while in the chain-play processing in step S28, play data of the next music piece is designated so as to play back the play data of the next music piece different from a music piece played back so far. In this case, it is checked in step S29 if play data of the next music piece to be played back is stored in the disk 12. If the play data is stored, the playback operation of the music piece is started; if no more play data is stored, the start address of play data of the first music piece stored in the internal ROM 4 is designated so as to start the playback operation of play data stored in the internal ROM 4.

Upon completion of these processing operations, the flow returns to step S2 to repeat the above-mentioned processing.

Figure 5:
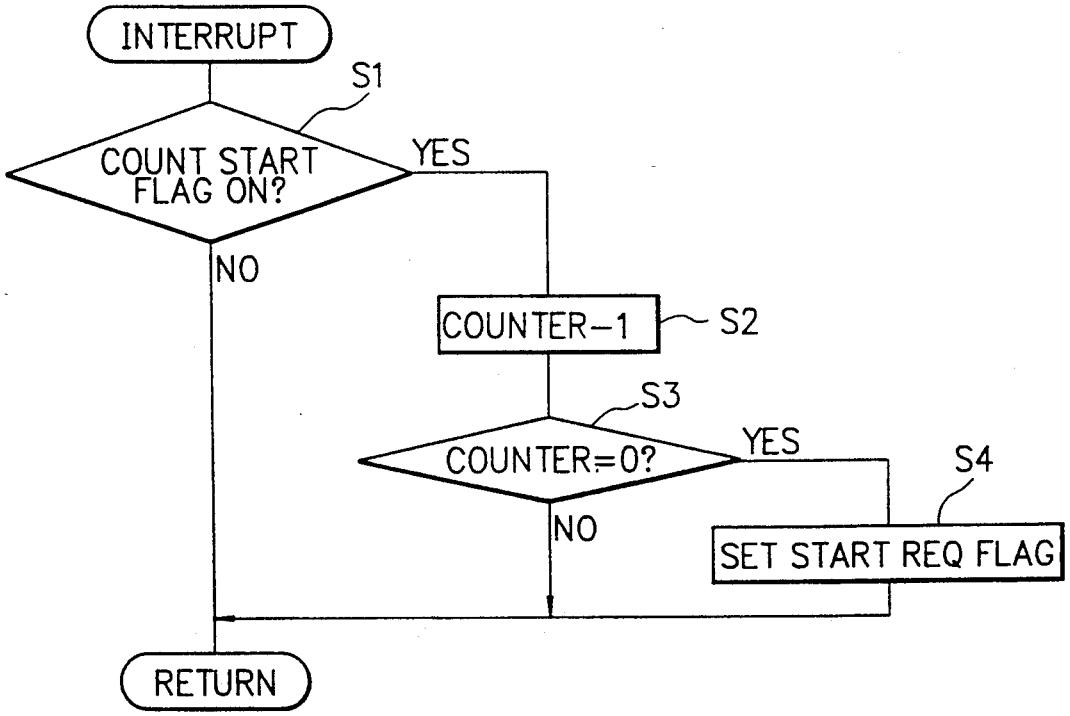
FIG. 5 is a flow chart for explaining interruption processing executed by the CPU 3.

FIG. 5 is a flow chart for explaining interruption processing executed by the CPU 3.

In this processing, in step S1, it is checked if the count start flag (see step S13 in FIG. 3) is set. If YES in step S1, the content of the counter is decremented by one in step S2, and it is then checked in step S3 if the content of the counter has reached 0. If NO in step S3, the flow returns to the main routine; otherwise, the start request flag, which indicates that the predetermined period of time has passed after the demonstration mode is set upon operation of the demonstration switch 20, is set, and the count start flag is cleared in step S4. Thereafter, the flow returns to the main routine.

Figure 6:
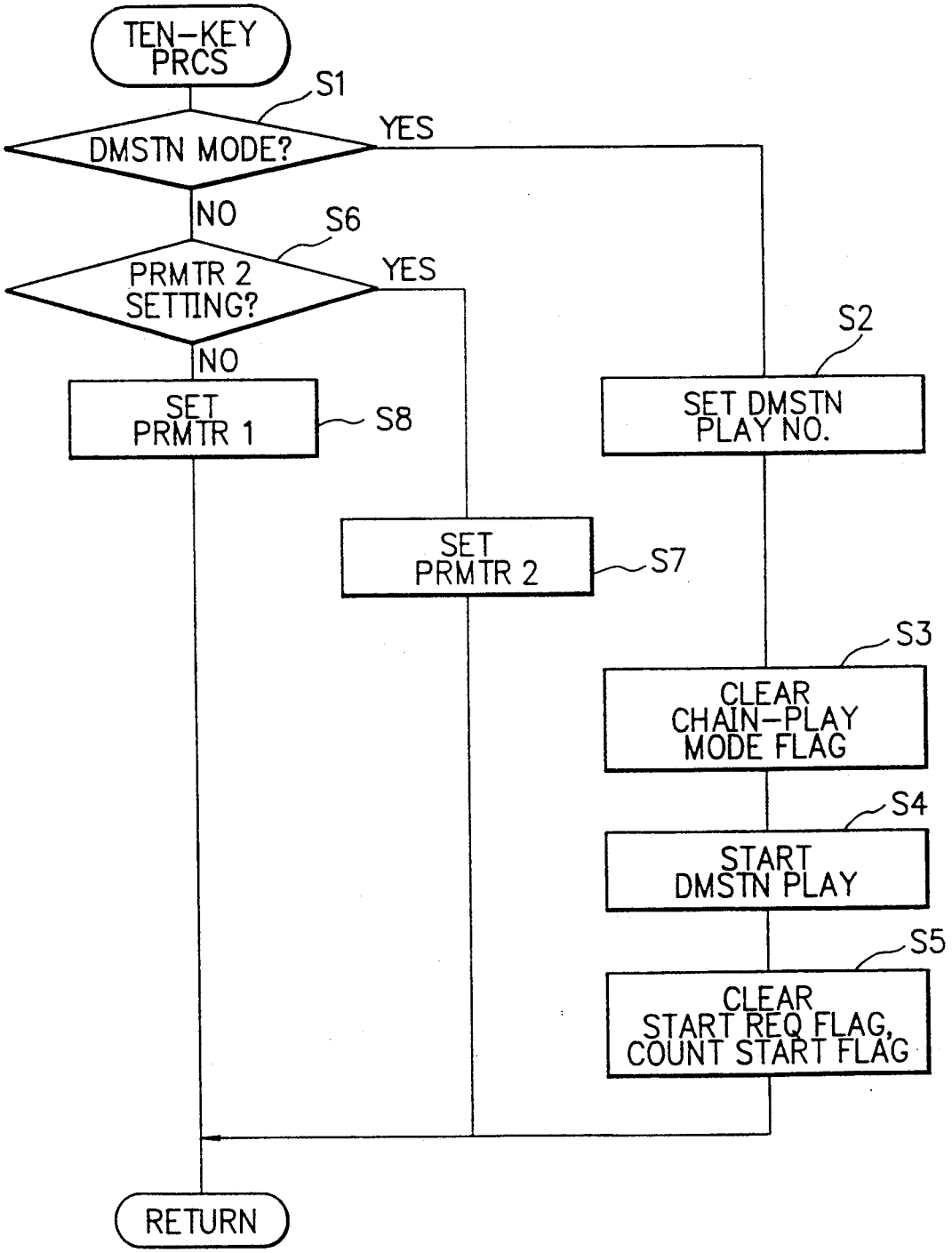
FIG. 6 is a flow chart showing the details of ten-key processing.

FIG. 6 is a flow chart showing the details of the ten-key processing executed in step S17 in FIG. 3.

In this processing, it is checked in step S1 if the demonstration mode is set. If YES in step S1, a numerical value input upon operation of the ten-key pad is set as a number of a music piece to be demonstrated in step S2. In step S3, the chain-play mode flag is cleared, and thereafter, in step S4, play data of a music piece corresponding to the number set in step S2 is read out from the disk 12 or the ROM 4 to start the single repeat play of the readout data. In this processing, when play data of the same music piece is stored in both the disk 12 and the ROM 4, the play data stored in the disk 12 may be preferentially read out and played back.

Upon completion of the processing in step S4, the flow advances to step S5 to clear the start request flag and the count start flag, and the flow then returns to the main routine.

If it is determined in step S1 that the demonstration mode is not set, it is checked in step S6 if the parameter 2 set mode is currently set. If YES in step S6, a numerical value input using the ten-key pad 23 is set as the value of the parameter 2 in step S7, and the flow returns to the main routine; otherwise, a numerical value input using the ten-key pad 23 is set as the value of the parameter 1 in step S8, and the flow returns to the main routine.

As described above, according to the above embodiment, when the demonstration switch 20 is depressed to set the demonstration mode (see steps S7 and S11 to S14 in FIG. 3), the chain-play for performing a continuous auto-play of a plurality of music pieces is automatically started after an elapse of the predetermined period of time (see steps S19 to S24 in FIG. 4, and FIG. 5) without selection of music pieces. Therefore, a continuous auto-play of a plurality of music pieces can be attained by an easy operation without requiring a music piece selection operation for selecting music pieces to be demonstrated.

The present invention has been described with reference to its embodiment. However, the present invention is not limited to the above-mentioned embodiment, and various effective changes and modifications may be made based on the technical principle of the present invention.

As described above, according to the auto-play apparatus of the present invention, a continuous auto-play of a plurality of music pieces can be quickly started by an easy operation.

What is claimed is:

1. An auto-play apparatus having storage means for storing auto-play data of a plurality of music pieces, and play means for performing an auto-play based on the auto-play data stored in said storage means, comprising:

mode set means for setting a demonstration mode for performing a continuous auto-play of a music piece;

music piece selection means for selecting a music piece to be continuously played back in the demonstration mode;

instruction means for, when said music piece selection means does not select a music piece for a predetermined period of time after the demonstration mode is set by said mode set means, instructing to start a chain-play for sequentially and continuously playing back a plurality of music pieces; and play means for, when said instruction means instructs to start the chain-play, sequentially reading out auto-play data of a plurality of music pieces from said storage means, and performing a continuous auto-play of the plurality of music pieces.

2. An apparatus according to claim 1, wherein said storage means comprises an external storage unit and an internal storage unit arranged in an apparatus main body, and said apparatus further comprises data read-out means for, when the start of the chain-play is instructed, starting a read-out operation of auto-play data from one of said two storage units, and for, when playback operations of music pieces stored in said one storage unit are ended, performing a read-out operation of auto-play data from the other storage unit.

* * * * *